United States Patent [19]

Yamane

[11] Patent Number: 4,569,520

[45] Date of Patent: Feb. 11, 1986

[54] THUMB INSERT FOR A BOWLING BALL

[76] Inventor: Jimmie F. Yamane, 7805 Goll Ave., North Hollywood, Calif. 91605

[21] Appl. No.: 622,736

[22] Filed: Jun. 20, 1984

Related U.S. Application Data

[63] Continuation-in-part of Ser. No. 581,335, Feb. 17, 1984, Pat. No. 4,530,502.

[51] Int. Cl.[4] ..... A63B 37/00

[52] U.S. Cl. ..... 273/63 A; 273/63 B

[58] Field of Search ..... 273/63 A, 63 B, 63 R, 273/63 F, 63 G

[56] References Cited

U.S. PATENT DOCUMENTS

| | | | |
|---|---|---|---|
| 950,838 | 3/1910 | Cavanagh | 273/63 A |
| 1,021,490 | 3/1912 | Scully | 273/63 A |
| 2,273,199 | 2/1942 | Hilton et al. | 273/63 A |
| 3,963,238 | 6/1976 | Patrignani | 273/63 A |
| 4,530,502 | 7/1985 | Yamane | 273/63 B |

*Primary Examiner*—George J. Marlo

*Attorney, Agent, or Firm*—W. Edward Johansen

[57] ABSTRACT

The present invention is a thumb insert in combination with a bowling ball having a thumb-hole which has an internal cylindrical sidewall. The thumb insert includes a substantially cylindrical member which is formed from a non-metallic, flexible material and which has a base portion. The substantially cylindrical member has an external cylindrical sidewall which is fixedly coupled to the internal cylindrical sidewall of the thumb-hole of the bowling ball adjacent to the base portion thereof. The substantially cylindrical member has a first longitudinal peripheral edge, a second longitudinal peripheral edge which is disposed oppositely and parallel to the first longitudinal peripheral edge and a third transverse peripheral edge which is adjacent and contiguous to both the first and second longitudinal peripheral edges. The first and second longitudinal peripheral edges extend substantially, but not completely, to the base portion thereof. The thumb insert also includes a flexible member which has an external semi-cylindrical surface and an internal semi-cylindrical sidewall. The thumb insert is disposed in the space formed by the first and second longitudinal peripheral edges and the third transverse peripheral edge so that the bowler can place the back of his thumb against the internal semi-cylindrical sidewall of the first portion and the front of his thumb contacts the internal semi-cylindrical sidewall of the second portion. The second portion is fixedly and rigidly coupled to the base portion so that the bowler can resiliently and snugly insert his thumb into the thumb-hole of the bowling ball.

5 Claims, 11 Drawing Figures

Fig. 1.
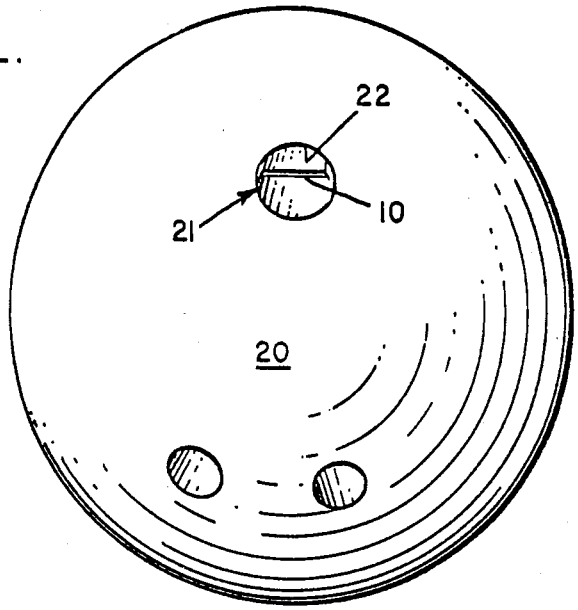
Fig. 2.
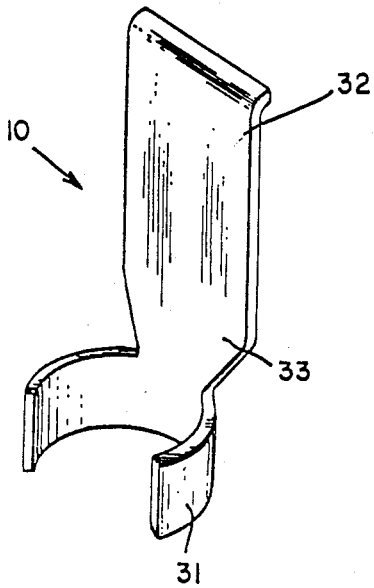
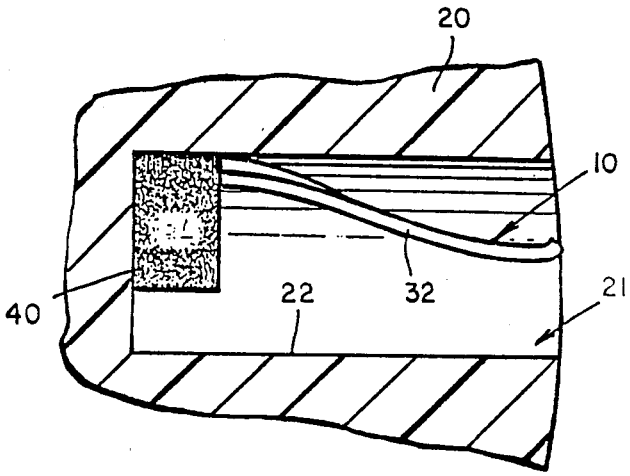
Fig. 3.
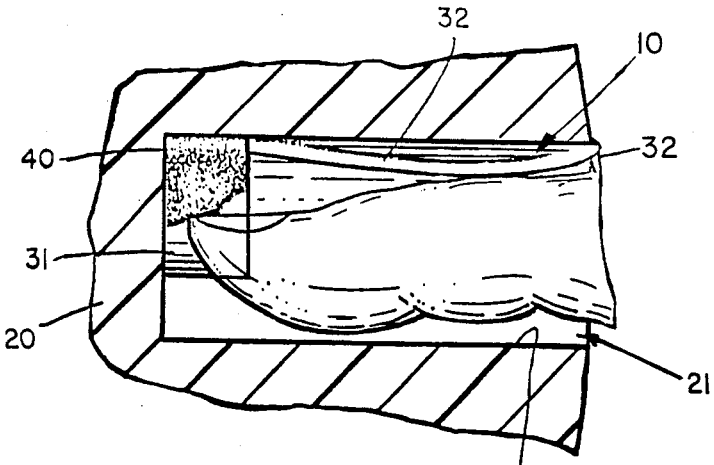
Fig. 4.

Fig. 5.
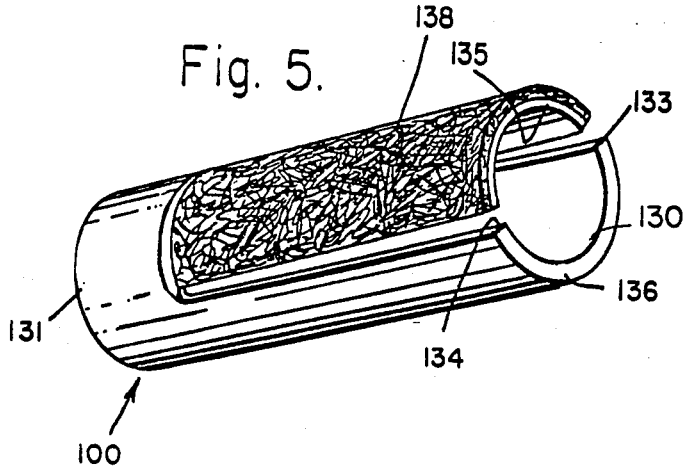
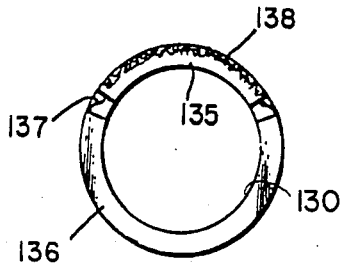
Fig. 6.
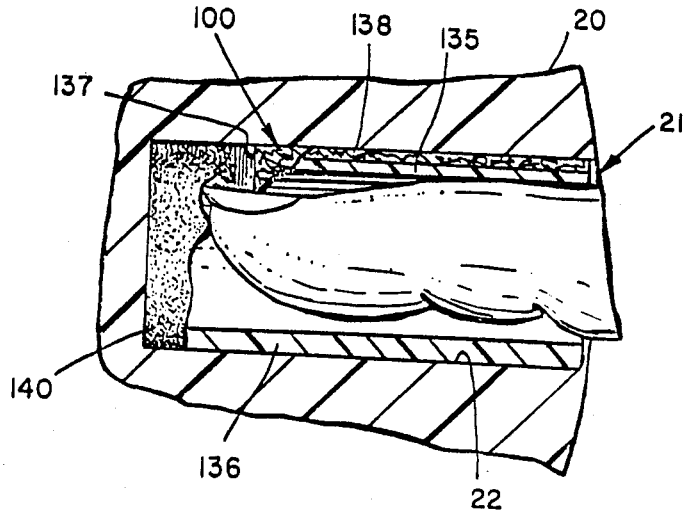
Fig. 7.

THUMB INSERT FOR A BOWLING BALL

This application is a continuation-in-part of the application, Ser. No. 581,335, filed Feb. 17, 1984 now U.S. Pat. No. 4,530,502.

BACKGROUND OF THE INVENTION

1. Field of the Invention

The present invention relates to a thumb insert which is disposed within and fixedly coupled at its base to the thumb-hole of a bowling ball and more particularly a thumb insert which resiliently couples the thumb of the bowler to the thumb-hole of the bowling ball.

2. Description of the Prior Art

U.S. Pat. No. 4,289,312, entitled Finger Grip Insert for a Bowling Ball, issued to Donald L. Heimbigner on Sept. 15, 1981, teaches a resilient insert which is installed within a bowling ball bore for the purpose of cushioning the user's finger tip. One wall segment of the insert extends the length of the insert and is of greater thickness than at least some of the remaining wall segments of the insert. The internal surface of the one wall segment is formed on a greater radius than the corresponding radii of certain remaining internal surfaces to more closely correspond to the transverse oval shape of the user's finger tip.

U.S. Pat. No. 4,416,452, entitled Bowling Ball Finger Grip Insert, issued to Donald L. Heimbigner on Nov. 22, 1983, teaches a finger grip insert for a bowling ball.

U.S. Pat. No. 4,381,863, entitled Finger Hole Insert for Bowling Balls, issued to Bill Norman on May 3, 1983, teaches a finger hole insert for bowling balls.

U.S. Pat. No. 4,289,312, entitled Finger Hole Insert for Bowling Balls, issued to Andrew J. Straboray on Nov. 9, 1982, teaches a novel ball gripping insert which is adapted to be attached within a receiving hole bored into the surface of a bowling ball in order to provide a lined thumb-receiving hole which improves the ability of the bowler to grip and release the bowling ball in the desired manner.

U.S. Pat. No. 3,963,238, entitled Bowling Ball and Gripping Device, issued to Jerry M. Patrignani on June 15, 1976, teaches a bowling ball grip which is adapted to be removably inserted into the digit receiving aperture of a bowling ball and thereby provide a secure fit.

U.S. Pat. No. 3,342,488, entitled Bowling Ball and Finger Hole Gripping Insert, issued to George F. Novatnak on Sept. 19, 1967, teaches an insert for the thumb hole of a bowling ball.

U.S. Pat. No. 3,804,412, entitled Taper Lock Inserts for Thumb and Fingers in Bowling Balls, issued to John Chetirko on Apr. 16, 1974, teaches an insert which is installed within a bowling ball and which has a particularly designed hexagonal opening for loosely receiving a thumb and wherein the lower or nail portion of the opening depresses and locks the thumb evenly on five sides of the opening. The insert expands radially. The end of the insert is flushed with the face of the bowling ball.

U.S. Pat. No. 3,784,198, entitled Finger Hole Liner for Bowling Ball, issued to Burton E. Bach on Jan. 8, 1874, teaches a pliable plastic liner for a finger hole in a bowling ball. When the pliable plastic liner is inserted within the inherently round finger hole of the bowling ball the opening in the pliable plastic liner becomes elliptical thereby increasing the bowler's control.

SUMMARY OF THE INVENTION

In view of the foregoing factors and conditions which are characteristic of the prior art it is the primary object of the present invention to provide a thumb insert which is disposed within and fixedly coupled at its base to the thumb-hole of a bowling ball and which resiliently couples the thumb of the bowler to the thumb-hole of the bowling ball.

In accordance with the present invention an embodiment of a thumb insert is described. A bowler uses the thumb insert with a bowling ball having a thumb-hole which has an internal cylindrical sidewall. The thumb insert is disposed in and fixedly coupled to the internal cylindrical sidewall of the thumb-hole. The thumb insert includes an integral member which is formed from a non-metallic, flexible material. The integral member has a substantially semi-cylindrical base portion which is fixedly coupled to the internal cylindrical sidewall of the thumb-hole of the bowling ball adjacent to the bottom portion thereof. The integral member also has a slightly curved portion against which the bowler places the back of his thumb so that the front of his thumb contacts the internal cylindrical sidewall of the thumb-hole of the bowling ball. The substantially semi-cylindrical base portion is resiliently coupled to the slightly curved portion whereby the bowler can resiliently and snugly insert his thumb into the thumb-hole of the bowling ball.

The features of the present invention which are believed to be novel are set forth with particularity in the appended claims.

Other claims and many of the attendant advantages will be more readily appreciated as the same becomes better understood by reference to the following detailed description and considered in connection with the accompanying drawing in which like reference symbols designate like parts throughout the figures.

DESCRIPTION OF THE DRAWING

FIG. 1 is a partial perspective drawing of a bowling ball which has a first embodiment of a thumb insert which has been constructed in accordance with the principles of the present invention.

FIG. 2 is a perspective drawing of the first embodiment of the thumb insert of FIG. 1.

FIG. 3 is a side elevational view in partial cross-section of the bowling ball of FIG. 1 showing the first embodiment of the thumb insert of FIG. 1 when a bowler does not have his thumb inserted therein.

FIG. 4 is a side elevational view in partial cross-section of the bowling ball of FIG. 1 showing the first embodiment of the thumb insert of FIG. 1 when a bowler does have his thumb inserted therein.

FIG. 5 is a perspective drawing of a second embodiment of a thumb insert which has been constructed in accordance with the principles of the present invention.

FIG. 6 is an end elevational view of the second embodiment of the thumb insert of FIG. 5 when a bowler does not have his thumb inserted therein.

FIG. 7 is a side elevational view in partial cross-section of a bowling ball showing the second embodiment of the thumb insert of FIG. 1 when a bowler does have his thumb inserted therein.

DESCRIPTION OF THE PREFERRED EMBODIMENT

Figure 8:
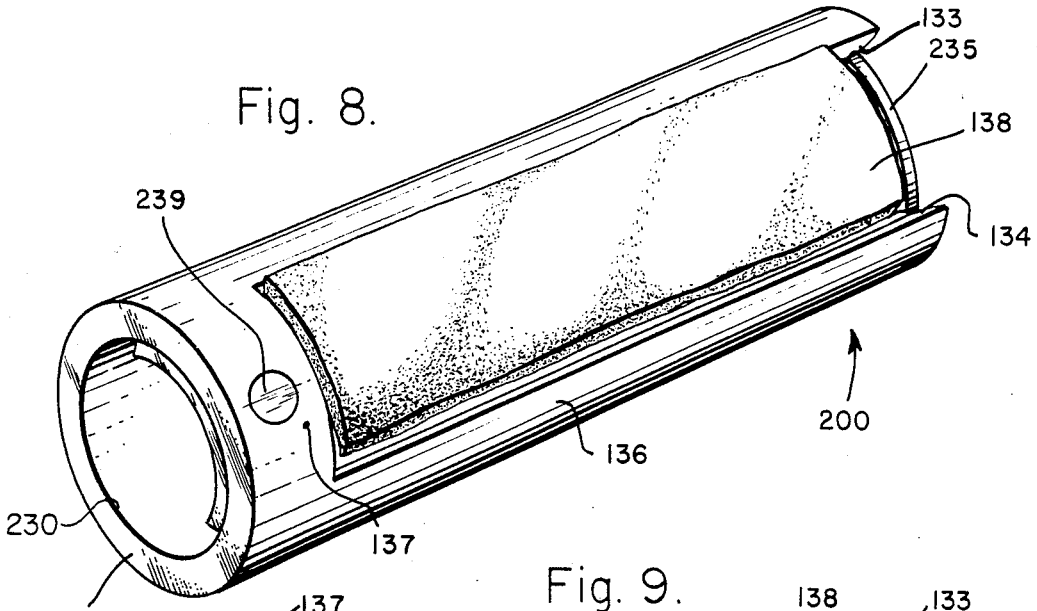
FIG. 8 is a perspective drawing of a third embodiment of a thumb insert which has been constructed in accordance with the principles of the present invention.

In order to best understand the present invention it is necessary to refer to the following description of its preferred embodiment in conjunction with the accompanying drawing. Referring to FIG. 1 in conjunction with FIG. 2 a bowler uses a first embodiment of a thumb insert 10 with a bowling ball 20 having a thumb-hole 21 which has an internal cylindrical sidewall 22. The thumb insert 10 includes an integral member which is formed from a non-metallic, flexible material, such as either dalren plastic material or nylon plastic material. The integral member has a substantially semi-cylindrical base portion 31 which is fixedly coupled to the internal cylindrical sidewall 22 of the thumb-hole 21 of the bowling ball 20 adjacent to the bottom portion 31 thereof.

Referring to FIG. 3 in conjunction with FIG. 1 and FIG. 4 the integral member also has a slightly curved portion 32 against which the bowler places the back of his thumb so that the front of his thumb contacts the internal cylindrical sidewall 22 of the thumb-hole 21 of the bowling ball 20. The substantially semi-cylindrical base portion 31 is resiliently coupled to the slightly curved portion 32 so that the bowler can resiliently and snugly insert his thumb into the thumb-hole 21 of the bowling ball 20. The thumb insert 10 is disposed in and fixedly coupled to the internal cylindrical sidewall 22 of the thumb-hole 21 of the bowling ball 20 by glue 40.

Referring to FIG. 5 in conjunction with FIG. 6 a bowler uses a second embodiment of a thumb insert 100 with a bowling ball 20 having a thumb-hole 21 which has an internal cylindrical sidewall 22. The thumb insert 100 is disposed in and fixedly coupled to the internal cylindrical sidewall 22 of the thumb-hole 21. The thumb insert 100 includes a substantially cylindrical member 130 which is formed from a non-metallic, flexible material, such as either a dalren plastic material or a nylon plastic material and which has a base portion 131. The substantially cylindrical member 130 has an external cylindrical sidewall which is fixedly coupled to the internal cylindrical sidewall 22 of the thumb-hole 21 of the bowling ball 20 adjacent to the base portion 131 thereof. The substantially cylindrical member 130 has a first longitudinal slit 133 and a second longitudinal slit 134 which is disposed oppositely and parallel to the first longitudinal slit 133. The first and second longitudinal slits 133 and 134 extend substantially, but not completely, to the base portion 131 thereof in order to divide the substantially cylindrical member 130 into a first portion 135 which has an external semi-cylindrical surface and an internal semi-cylindrical sidewall and a second portion 136 which has an external semi-cylindrical sidewall and an internal semi-cylindrical sidewall so that the bowler can place the back of his thumb against the internal semi-cylindrical sidewall of the first portion 135 and the front of his thumb contacts the internal semi-cylindrical sidewall of the second portion 136. The second portion 136 is fixedly and rigidly coupled to the base portion 131. The first portion 135 is resiliently coupled to the base portion 131 so that the bowler can resiliently and snugly insert his thumb into the thumb-hole 21 of the bowling ball 20. The first portion 135 of the substantially cylindrical member 130 may be uniformly reduced in thickness in order to provide more space for the thumb of the bowler.

Referring to FIG. 7 in conjunction with FIG. 5 the thumb insert 100 also includes a cushioning pad 138 which is disposed on the external semi-cylindrical surface of the first portion 135 in order to provide a cushion for the back of the thumb of the bowler. The thumb insert 100 is disposed in and fixedly coupled to the internal cylindrical sidewall 22 of the thumb-hole 21 of the bowling ball 20 by glue 140.

Figure 9:
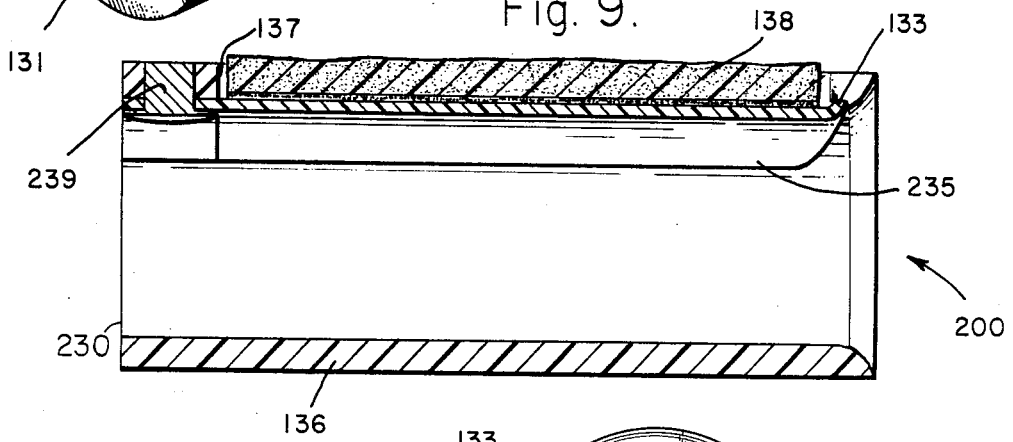
FIG. 9 is a side elevational view in cross-section of the third embodiment of the thumb insert of FIG. 8.

Referring to FIG. 1 and FIG. 8 in conjunction with FIG. 9 a bowler uses a third embodiment of a thumb insert 200 with a bowling ball 20 having a thumb-hole 21 which has an internal cylindrical sidewall 22. The thumb insert 200 is disposed in and fixedly coupled to the internal cylindrical sidewall 22 of the thumb-hole 21. The thumb insert 200 includes a substantially cylindrical member 230 which is formed from a non-metallic, flexible material, such as rubber or either a dalren plastic material or a nylon plastic material and which has a base portion 231. The substantially cylindrical member 230 has an external cylindrical sidewall which is fixedly coupled to the internal cylindrical sidewall 22 of the thumb-hole 21 of the bowling ball 20 adjacent to the base portion 231 thereof. The substantially cylindrical member 230 has a first longitudinal slit 233, a second longitudinal slit 234 which is disposed oppositely and parallel to the first longitudinal slit 233, and a third transverse slit which is adjacent to the base portion 231 and contiguous to both the first and second longitudinal slits 233 and 234. The first and second longitudinal slits 233 and 234 extend completely to the third transverse slit in the base portion 231 in order to remove a first portion which has an external semi-cylindrical surface and an internal semi-cylindrical sidewall from the substantially cylindrical member 230 thereby leaving a second portion 235 and a base portion 236. The second portion 235 has an external semi-cylindrical sidewall and an internal semi-cylindrical sidewall so that the bowler can place the back of his thumb against the internal semi-cylindrical sidewall of the first portion and the front of his thumb contacts the internal semi-cylindrical sidewall of the second portion 235. A flexible member 237 is similar in shape as the removed first portion and has an external semi-cylindrical surface and an internal semi-cylindrical sidewall. The flexible member 237 is formed out of teflon or a plastic material and is disposed in the space formed by removing the first portion of the substantially cylindrical member 230 so that the bowler can place the back of his thumb against the internal semi-cylindrical sidewall of the flexible member 237 and the front of his thumb contacts the internal semi-cylindrical sidewall of the second portion 235. The second portion 235 is fixedly and rigidly coupled to the base portion 231 so that the bowler can resiliently and snugly insert his thumb into the thumb-hole 21 of the bowling ball 20. Either a non-metallic or plastic rivet 238 secures the flexible member 237 to the base portion 231.

Figure 10:
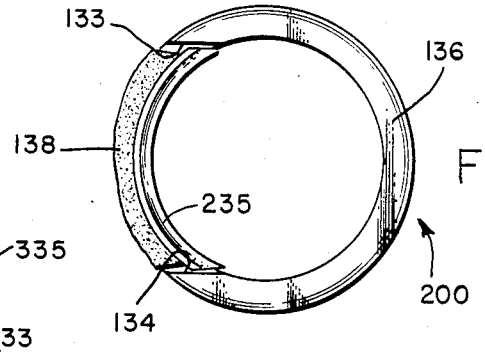
FIG. 10 is an end elevational view of the third embodiment of the thumb insert of FIG. 8.

Referring to FIG. 10 in conjunction with FIG. 8 and FIG. 9 the thumb insert 200 also includes a cushioning pad 239 which is disposed on the external semi-cylindrical surface of the flexible member 237 in order to provide a cushion for the back of the thumb of the bowler.

Figure 11:
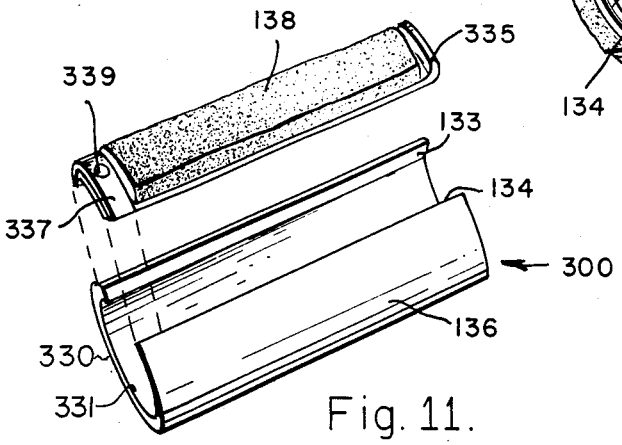
FIG. 11 is a perspective drawing of a fourth embodiment of a thumb insert which has been constructed in accordance with the principles of the present invention.

Referring to FIG. 11 a bowler uses a fourth embodiment of a thumb insert 300 with a bowling ball 20 having a thumb-hole 21 which has an internal cylindrical sidewall 22. The thumb insert 300 is disposed in and fixedly coupled to the internal cylindrical sidewall 22 of the thumb-hole 21. The thumb insert 300 includes a substantially cylindrical member 330 which is formed from a non-metallic, flexible material, such as rubber or either a dalren plastic material or a nylon plastic material and which has a base portion 331. The substantially cylindrical member 330 has an external cylindrical sidewall which is fixedly coupled to the internal cylindrical sidewall 22 of the thumb-hole 21 of the bowling ball 20 adjacent to the base portion 331 thereof. The substantially cylindrical member 330 has a first longitudinal slit 333 and a second longitudinal slit 334 which is disposed oppositely and parallel to the first longitudinal slit 333. The first and second longitudinal slits 333 and 334 extend completely through the base portion 331 in order to remove a first portion which has an external semi-cylindrical surface and an internal semi-cylindrical sidewall from the substantially cylindrical member 330 thereby leaving a second portion 335 which has an external semi-cylindrical sidewall and an internal semi-cylindrical sidewall so that the bowler can place the back of his thumb against the internal semi-cylindrical sidewall of the first portion and the front of his thumb contacts the internal semi-cylindrical sidewall of the second portion 335. A flexible member 337 is similar in shape as the removed first portion and has an external semi-cylindrical surface and an internal semi-cylindrical sidewall. The flexible member 337 is formed out of teflon or a plastic material and is disposed in the space formed by removing the first portion of the substantially cylindrical member 330 so that the bowler can place the back of his thumb against the internal semi-cylindrical sidewall of the flexible member 337 and the front of his thumb contacts the internal semi-cylindrical sidewall of the second portion 335. The second portion 335 is fixedly and rigidly coupled to the base portion 331 so that the bowler can resiliently and snugly insert his thumb into the thumb-hole 21 of the bowling ball 20. Either a non-metallic or plastic rivet 338 secures the flexible member 337 to a curved member 339 which is fixedly coupled to the second portion 335.

The thumb insert 300 also includes a cushioning pad 340 which is disposed on the external semi-cylindrical surface of the flexible member 337 in order to provide a cushion for the back of the thumb of the bowler.

From the foregoing it can be seen that a thumb insert for a use with a bowling ball has been described. It should be noted that the sketches are not drawn to scale and that distances of and between the figures are not to be considered significant.

Accordingly it is intended that the foregoing disclosure and showing made in the drawing shall be considered only as an illustration of the principles of the present invention.

What is claimed is:

1. A thumb insert which a bowler uses with a bowling ball having a thumb-hole having an internal cylindrical sidewall and which is disposed in and fixedly coupled to the internal cylindrical sidewall of the thumb-hole, said thumb insert comprising:

a. a substantially cylindrical member which is formed from a non-metallic, flexible material and which has a base portion, said substantially cylindrical member having an external cylindrical sidewall which is fixedly coupled to the internal cylindrical sidewall of the thumb-hole of the bowling ball adjacent to the base portion thereof, said substantially cylindrical member having a first longitudinal slit and a second longitudinal slit which is disposed oppositely and parallel to said first longitudinal slit, said first and second longitudinal slits extending substantially, but not completely, to said base portion thereof in order to divide said substantially cylindrical member into a first portion having an external semi-cylindrical surface and an internal semi-cylindrical sidewall and a second portion having an external semi-cylindrical sidewall and an internal semi-cylindrical sidewall so that the bowler can place the back of his thumb against said internal semi-cylindrical sidewall of said first portion and the front of his thumb contacts said internal semi-cylindrical sidewall of said second portion wherein said second portion is fixedly and rigidly coupled to said base portion; and b. resiliently coupling means for resiliently coupling said first portion to said base portion whereby the bowler can resiliently and snugly insert his thumb into the thumb-hole of the bowling ball.

2. A thumb insert according to claim 1 wherein said first portion of said substantially cylindrical member has been uniformly reduced in thickness and wherein said thumb insert also comprises a cushioning pad which is disposed on said external semi-cylindrical surface of said first portion in order to provide a cushion for the back of the thumb of the bowler.

3. A thumb insert according to claim 1 wherein said thumb insert also comprises a cushioning pad which is disposed on said external semi-cylindrical surface of said first portion in order to provide a cushion for the back of the thumb of the bowler.

4. A thumb insert in combination with a bowling ball having a thumb-hole having an internal cylindrical sidewall and which is disposed in and fixedly coupled to the internal cylindrical sidewall of the thumb-hole, said thumb insert comprising:

a. a substantially cylindrical member which is formed from a non-metallic, flexible material and which has a base portion, said substantially cylindrical member having an external cylindrical sidewall which is fixedly coupled to the internal cylindrical sidewall of the thumb-hole of the bowling ball adjacent to the base portion thereof, said substantially cylindrical member having a first longitudinal peripheral edge, a second longitudinal peripheral edge which is disposed oppositely and parallel to said first longitudinal peripheral edge and a third transverse peripheral edge which is adjacent and contiguous to both said first and second longitudinal peripheral edges, said first and second longitudinal peripheral edges extending substantially, but not completely, to said base portion thereof; and b. a flexible member which has an external semi-cylindrical surface and an internal semi-cylindrical sidewall is disposed in the space formed by said first and second longitudinal peripheral edges and said third transverse peripheral edge so that the bowler can place the back of his thumb against said internal semi-cylindrical sidewall of said first portion and the front of his thumb contacts said internal semi-cylindrical sidewall of said second portion wherein said second portion is fixedly and rigidly coupled to said base portion whereby the bowler can resiliently and snugly insert his thumb into the thumb-hole of the bowling ball.

5. A thumb insertion combination with a bowling ball according to claim 4 wherein said thumb insert also comprises a cushioning pad which is disposed on said external semi-cylindrical surface of said flexible member in order to provide a cushion for the back of the thumb of the bowler.

* * * * *